US006076268A

United States Patent [19]

Fuhr

[11] Patent Number: 6,076,268

[45] Date of Patent: Jun. 20, 2000

[54] TOOL ORIENTATION WITH ELECTRONIC PROBES IN A MAGNETIC INTERFERENCE ENVIRONMENT

[75] Inventor: Richard R. Fuhr, Yukon, Okla.

[73] Assignee: Dresser Industries, Inc., Dallas, Tex.

[21] Appl. No.: 08/986,466

[22] Filed: Dec. 8, 1997

[51] Int. Cl.[7] ..... E21B 47/022; E21B 25/16; E21B 47/00

[52] U.S. Cl. ..... 33/304; 175/45; 166/255.2

[58] Field of Search ..... 33/302, 303, 304, 33/313, 316, 318; 175/45, 4.51; 166/255.2

[56] References Cited

U.S. PATENT DOCUMENTS

| | | | |
|---|---|---|---|
| 3,704,749 | 12/1972 | Estes et al. | 166/255 |
| 3,964,553 | 6/1976 | Basham et al. | 33/304 |
| 4,410,051 | 10/1983 | Daniel et al. | 175/45 |
| 4,593,770 | 6/1986 | Hoehm, Jr. | 175/45 |
| 4,682,421 | 7/1987 | Van Dongen et al. | 33/302 |
| 5,103,177 | 4/1992 | Russell et al. | 175/45 |
| 5,435,069 | 7/1995 | Nicholson | 33/304 |
| 5,582,248 | 12/1996 | Estes | 175/45 |
| 5,787,997 | 8/1998 | Hartmann | 177/45 |
| 5,806,194 | 9/1998 | Rodney et al. | 33/304 |

*Primary Examiner*—Randy W. Gibson
*Attorney, Agent, or Firm*—Cox & Smith Incorporated

[57] ABSTRACT

An apparatus and method for orienting directional tools within a bore hole by recognizing and compensating for field biases brought about by ferromagnetic anamolies surrounding the bore hole, ferromagnetic casing strings and electrical/electronic tool components. The present invention includes the steps of measuring the magnetic field within a bore hole before casing strings are put in place and again measuring the magnetic field after such casings are in place. The ferromagnetic formation anamolies are detected in the first step of measuring the field prior to casing placement and further bias characteristics are determined in the second magnetic field measurement step after the casings are placed. Alternately, a conventional gyroscopic survey can be carried out to establish a bias in an already cased bore hole. Once a magnetic field bias has been established for the bore hole (for a particular casing string) this field bias is utilized to calculate and correct an azimuthal reading measured by electronic tools during placement within a particular casing. For a given location Y within the bore hole the field biases previously determined and resulting from formational anamolies and adjacent casings are factored into an azimuthal calculation in order to provide an accurate azimuth for tool orientation.

2 Claims, 2 Drawing Sheets

TOOL ORIENTATION WITH ELECTRONIC PROBES IN A MAGNETIC INTERFERENCE ENVIRONMENT

FIELD OF THE INVENTION

The present invention relates to an apparatus and method for orienting a directional tool in a bore hole. The present invention relates more specifically to an apparatus and method for orienting a directional tool within a bore hole environment that is subject to electromagnetic interferences brought about by ferrous formation structures and ferromagnetic casing strings.

BACKGROUND OF THE INVENTION

The production of oil or gas from a drilled well quite commonly involves bore hole operations carried out by means of a variety of tools lowered to various depths within the bore hole. In many situations where the formation traversed by a bore hole contains a number of petroleum-bearing strata at different depths, it is common practice to insert a number of casing strings into the bore hole and to isolate the strata so as to provide multiple zones of petroleum production. After a plurality of casing strings are installed and cemented, it is often necessary to perforate the strings at various depths in order to effect production from each zone. In order to perforate a string without damaging adjacent strings, information regarding the orientation of the perforator is necessary. In any of a number of other bore hole tool operations, it is also necessary to determine the orientation of the tool when it is positioned at a selected depth. Many such tools are lowered on cables which makes it difficult to predict with any certainty the orientation of the tool from the surface.

Efforts have been made in the past to utilize the earth's magnetic field as the basis for determining an azimuth or direction for a particular tool face once positioned at a depth in a bore hole. Unfortunately, there are too many interfering factors associated with the earth's magnetic field brought about by ferrous formations surrounding the bore hole, ferromagnetic casing strings placed within the bore hole, and electrical/electronic tools that generate electromagnetic fields within the bore hole. Given all of these interference factors, other methods of determining tool orientation have generally been focused on. Included among these are a number of radiation-based orientation devices that require adjacent casing strings to be radioactively tagged in order to be avoided by a perforator tool. In addition, various gyroscopic orientation devices have been devised that attempt to detect changes in the tool's orientation as it is lowered into the bore hole. Each of these devices fails to either provide an accurate azimuth for tool face orientation or achieves an accurate azimuth only at the cost of highly complex and expensive equipment.

U.S. Pat. No. 3,704,749 issued to Estes et al. on Dec. 5, 1972, entitled "Method and Apparatus for Tool Orientation in a Bore Hole" describes a method for introducing an axially symmetrical electromagnetic field within the bore hole and providing at least two receiver coils for measuring the magnetic field at an adjacent location. Electronic devices are provided to convert voltages from the receiver coils to a signal that is received at the surface and forms the basis for calculating an orientation azimuth.

U.S. Pat. No. 3,964,553 issued to Basham et al. on Jun. 22, 1976, entitled "Borehole Tool Orienting Apparatus and Systems" describes the use of a moving permanent magnetic assembly designed to generate a magnetic field about the casing string and borehole, and a number of receiver devices to measure the distorted magnetic field due to the presence of ferrous anamolies. The receiver is rotated to produce an azimuthal scan so that the location of the anamolies can be determined.

The Basham et al. patent describes an orienting device in which motion is imparted to a permanent magnet assembly to generate a moving magnetic field and receiver means that generate signals when the magnetic field is distorted due to the presence of a ferrous anamoly. The receiver means are rotated to produce an azimuthal scan such that signals are induced in the receiver means from which the azimuthal location of the anamoly can be determined.

U.S. Pat. No. 4,410,051 issued to Daniel et al. on Oct. 18, 1983, entitled "System and Apparatus for Orienting a Well Casing Perforating Gun" describes a mechanical assembly whereby a perforating gun is appropriately oriented in what is anticipated to be a slant well. The mechanisms of the Daniel et al. patent operate based upon inertial and gravitational forces as opposed to magnetic or radiation methods.

U.S. Pat. No. 5,582,248 issued to Estes, et al. on Dec. 10, 1996, entitled "Reversal-Resistant Apparatus for Tool Orientation in a Borehole" describes an electromagnetic method for accommodating ferrous non-uniformities in the region of the well bore. The method incorporates a measurement of the distortion of the otherwise axially symmetrical electromagnetic field created by the device as it is lowered into a specific casing. The Estes et al. patent includes a device for orientating a tool, such as perforator, with respect to a ferrous body, such as an adjacent casing string, wherein the orienting device utilizes an excitor coil producing an alternating electromagnetic field and a pair of receiver coils longitudinally spaced from the excitor coils. The position of the receiver coils being such that the voltages induced therein vary differentially with the angle presented by the detected ferrous body by reason of the distortion of the otherwise axially symmetric field.

While the prior art electromagnetic orientation devices, such as those described above, allow orientation of a perforator tool or the like with respect to adjacent tubing casing strings, problems arise when in the proximity of large ferrous masses the actual azimuthal orientation "signal" becomes weak as being overridden by the larger ferrous mass.

SUMMARY OF THE INVENTION

It is therefore an object of the present invention to provide an apparatus and method for orienting a directional tool within a bore hole, such as an oil or gas well, that may include electromagnetic interference factors such as ferromagnetic casing strings and ferrous formation anamolies surrounding the bore hole.

It is another object of the present invention to provide an apparatus and method for orienting a directional tool within a bore hole by measuring and recording magnetic field characteristics and determining magnetic biases caused by the various electromagnetic interference factors.

It is a further object of the present invention to provide an improved apparatus and method for orienting tools in bore holes subject to interfering electromagnetic factors without the need for costly and complicated orientation equipment or dangerous radioactive tagging methods.

It is a further object of the present invention to provide an improved apparatus and method for orienting tools within a bore hole that permits a quick and accurate determination of an azimuthal reading based upon previously established electromagnetic field bias quantities that may be incorporated into a correct azimuthal calculation.

In fulfillment of these and other objectives the present invention provides an apparatus and method for orienting directional tools within a bore hole by recognizing and compensating for field biases brought about by ferromagnetic anamolies surrounding the bore hole and ferromagnetic casing strings. A first embodiment of the present invention includes the steps of measuring the magnetic field within a bore hole before casing strings are put in place and again measuring the magnetic field after such casings are in place. The ferromagnetic formation anamolies are detected in the first step of measuring the field prior to casing placement and further bias characteristics are determined in the second magnetic field measurement step after the casings are placed.

A second embodiment of the present invention includes the step of making a conventional gyroscopic survey after casing strings are put in place to provide an azimuthal survey of the well bore, from which bias characteristics can be determined. The gyroscopic survey takes the place of the first magnetic survey in the first embodiment of the present invention. Once a bias has been established for the bore hole (for a particular casing string) this bias is utilized to calculate and correct an azimuthal reading measured by electronic tools during placement within a particular casing. For a given location Y within the bore hole the field biases previously determined as resulting from formational anamolies and adjacent casings are factored into an azimuthal calculation in order to provide an accurate azimuth for tool orientation.

Other objects, advantages, and features of the present invention will become apparent to those skilled in the art from the following description of a preferred embodiment taken in conjunction with the accompanying drawings and the appended claims.

DETAILED DESCRIPTION OF THE PREFERRED EMBODIMENTS

Figure 1:
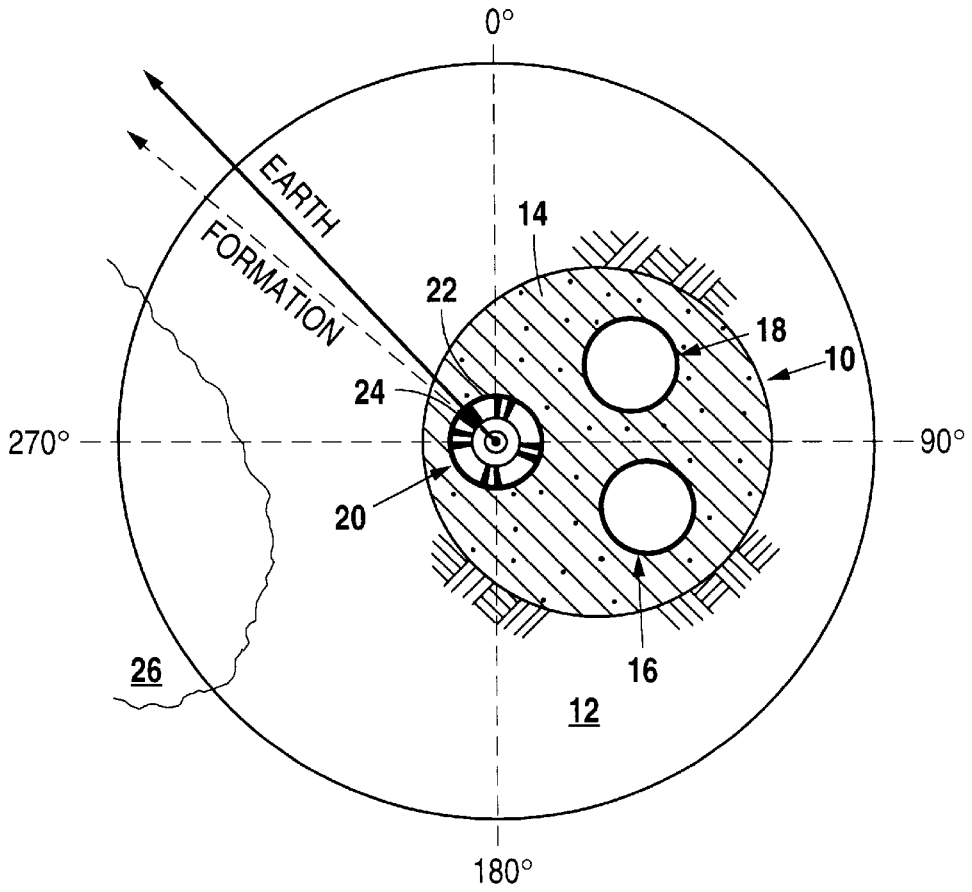
FIG. 1 is a cross-sectional view of a bore hole at a depth where the orientation of a directional tool is required, showing typical arrangements with respect to formation anamolies and casing strings within a single bore hole.

Reference is first made to FIG. 1 for a brief description of the structural orientation of the measurement devices utilized in conjunction with the present invention. Bore hole (10) within surrounding formation (12) is shown with a plurality of casing strings cemented or otherwise rigidly positioned within cement (14). Casing strings (16), (18), and (20) are positioned as they typically might be within bore hole (10) in order to facilitate production from a plurality of strata penetrated by the bore hole.

In the example shown in FIG. 1, casing string (20) is the casing of concern for the purposes of orienting a directional tool. The requirement of orienting the tool may be, for example, to perforate the casing at a particular location within the bore hole. In such an instance it is desirable to orient the perforation tool away from casing strings (16) and (18) so as to not damage or perforate these strings in the process.

Within casing string (20) there is shown orientation tool (22) operable in conjunction with directional tool face (24). Orientation tool (22) could be any of a number of well-known magnetic azimuthal measuring devices currently utilized in down hole operations. The magnetic measuring device described simply detects the magnetic field at a depth location and a particular orientation. In an ideal environment the earth's magnetic field might be sufficient to establish a measurable field that interacts with the ferrous anamolies in the formation and the ferromagnetic materials within the bore hole. In most instances, however, it is desirable to introduce an axially symmetrical magnetic field such as is described in the prior art, and to incorporate this "baseline" magnetic field in the overall measurement of the resulting field. In FIG. 1 a 360° azimuthal grid is shown around the orientation tool (22) positioned within casing string (20). A first vector (earth) indicates a measured orientation for tool face (24) based solely upon the effects of the earth's magnetic field as measured by orientation tool (22). A second vector (formation) shown adjacent to the earth's magnetic field vector indicates a corrected orientation once a field bias is determined for a particular position as brought about by ferrous anamoly (26) shown in formation (12) surrounding bore hole (10). Further biases are similarly incorporated that result from the ferromagnetic interferences caused by adjacent casing strings (16) and (18). These biases are then incorporated into an azimuthal calculation that correctly identifies the orientation of tool face (24).

Figure 2:
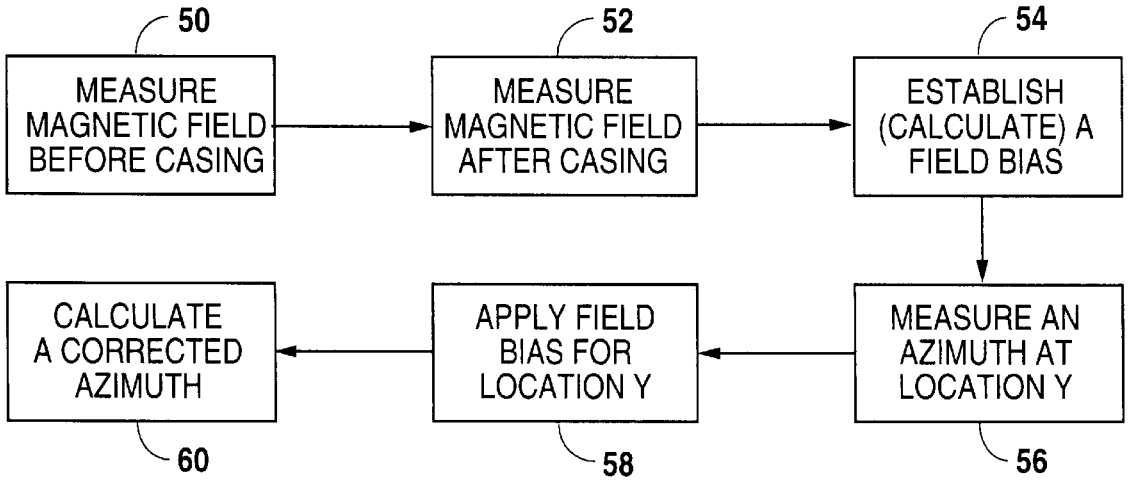
FIG. 2 is a flow chart of a first method of the present invention indicating the various measurements and calculations made in the process.

Reference is now made to FIG. 2 for a brief description of a first method of the present invention utilizing the structural system described briefly above with respect to FIG. 1. Basically the method involves measuring the magnetic field characteristics at a variety of stages in the operational use of an oil or gas bore hole. As long as an accurate measurement of magnetic field characteristics is made at each stage in the process, the changes in the magnetic field characteristics in the bore hole can be recorded and used as a means for compensation later when accurate azimuthal measurements are required.

The first step in the process as described in FIG. 2 involves the measurement of the magnetic field within the bore hole before a casing is placed (50). This is followed by the measurement of the magnetic field within the bore hole after a casing (or casings) is placed (52). These two magnetic field measurements are sufficient to provide a means for establishing (calculating) a field bias profile throughout the bore hole (54). The field bias at any point in the profile is simply the difference between the two magnetic field measurements made before and after a casing is placed.

Once the field bias for the bore hole has been determined and stored, a measurement of an azimuth at any specific location Y (56) can be corrected by applying the field bias for that location Y (58) in order to finally determine and calculate a corrected azimuthal value (60). That is, an azimuthal value measured at any specific location is altered (+/−) by the known field bias at that point. For example, if a field bias at a specific location is known to be −3.25°, that value is used to correct a measured tool face azimuth of 184.5° to 187.30°.

Figure 3:
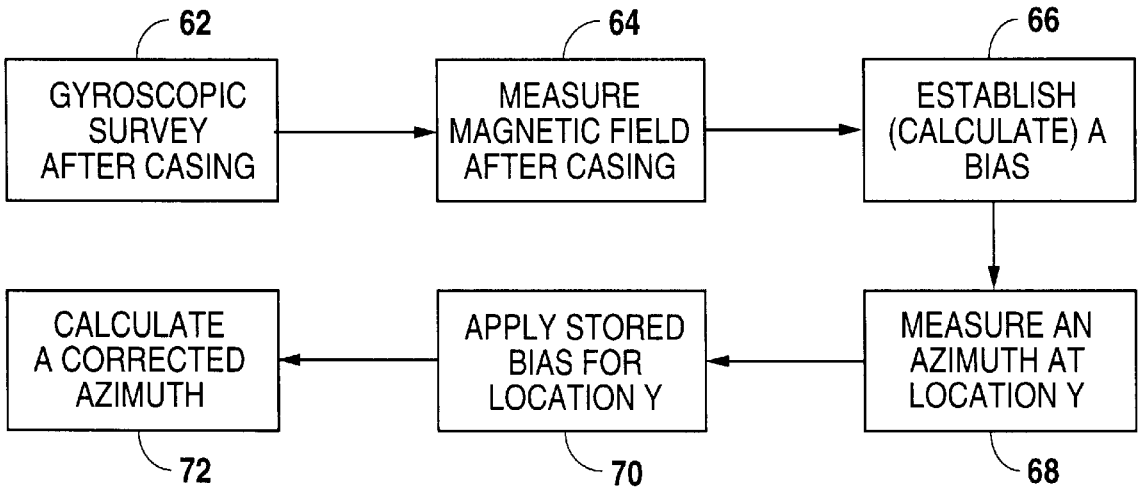
FIG. 3 is a flow chart of a second method of the present invention indicating the various measurements and calculations made in the process.

Reference is now made to FIG. 3 for a brief description of a second method of the present invention utilizing the structural system described briefly above with respect to FIG. 1. The second method differs from the first in that a conventional gyroscopic survey is accomplished in place of the initial step of measuring the magnetic field described above in conjunction with the first method of the present invention. This permits use of the method of the present invention in conjunction with bore holes that have already had casing strings placed.

The first step in the process as described in FIG. 3 involves a gyroscopic survey carried out within the bore hole after a casing is placed (62). Gyroscopic surveys are well known in the art and comprise the use of orthogonally oriented gyroscope arrays to determine orientation based on motion from an initial reference orientation. It is further known to correlate gyroscopic survey data with known characteristics of the earth's magnetic field at the location of the borehole. A nominal or baseline profile of the magnetic field is therefore established. The gyroscopic survey is followed by measurement of the magnetic field within the bore hole in the same casing string (64). These measurements are sufficient to provide a means for establishing (calculating) a field bias profile throughout the bore hole (66).

Once the field bias profile for the bore hole has been determined and stored, the measurement of an azimuth at any specific location Y (68) can be corrected by applying the field bias for the location Y (70) in order to finally determine and calculate a corrected azimuthal value (72) in a manner similar to that described above.

The preferred embodiments of the present invention as shown and described anticipate the use of variety of different magnetic azimuthal orientation devices used in conjunction with the system and methods described and claimed by the present invention. These examples demonstrate one way in which the concepts involved in the invention can be applied and practiced to achieve the desired result of accurately orienting a tool face. It is to understood that the actual physical configuration of the device used to apply the methods of the present invention could be varied in a number of ways that would be apparent to those skilled in the art. It is conceivable that a variety of electromagnetic field measuring devices could be utilized to not only detect the magnetic field characteristics surrounding the bore hole but also to generate appropriate baseline magnetic fields to facilite the measurement and determination of azimuthal readings. The methods of the present invention contemplate magnetic field configurations that could be varied as opposed to static. In addition, a variety of receiving coils or devices could be disposed in a manner that more or less accurately measures the resultant electromagnetic fields about the bore hole.

It is also, of course, apparent that the directional tool involved could be any of a number of devices other than the perforator gun suggested in the examples. The descriptions, disclosures, and examples provided in the specifications and the drawings are illustrative of the principles of the invention and are not to be interpreted in a limiting sense.

I claim:

1. A method for sub-surface placement of a directional tool in a bore hole and for determining the orientation of said directional tool within said bore hole comprising the steps of:

measuring an electromagnetic field profile within said bore hole prior to a placement of ferromagnetic casing strings within said bore hole;

measuring an electromagnetic field profile within said bore hole after said ferromagnetic casing strings have been placed within said bore hole;

calculating a magnetic field bias profile brought about by a combination of modifications to the earth's magnetic field caused by ferrous anamolies in a formation around said bore hole and interferences caused by said ferromagnetic casing strings in order to establish a field bias for said bore hole;

measuring an azimuthal orientation at a specific depth location in said bore hole;

applying a field bias for said specific depth location within said bore hole; and calculating a corrected azimuthal orientation based upon said applied field bias for said specific depth location.

2. A method for sub-surface placement of a directional tool in a bore hole and for determining the orientation of said directional tool within said bore hole comprising the steps of:

carrying out a gyroscopic survey within said bore hole after a placement of ferromagnetic casing strings within said bore hole;

measuring an electromagnetic field profile within said bore hole after said step of carrying out said gyroscopic survey within said bore hole;

calculating a bias profile brought about by a combination of modifications to the earth's magnetic field caused by ferrous anomalies in a formation around said bore hole and interferences caused by said ferromagnetic casing strings in order to establish an overall bias profile for said bore hole from said gyroscopic survey;

measuring an azimuthal orientation of a specific depth location in said bore hole;

applying a field bias for said specific depth location within said bore hole; and calculating a corrected azimuthal orientation based upon said applied bias for said specific depth location.

* * * * *